United States Patent [19]

Ogilvie

[11] Patent Number: 4,925,191

[45] Date of Patent: May 15, 1990

[54] PUTTING TARGET

[76] Inventor: Garry J. Ogilvie, 2555 Hempstead, Auburn Hills, Mich. 48057

[21] Appl. No.: 403,576

[22] Filed: Sep. 6, 1989

[51] Int. Cl.[5] ..... A63B 69/36

[52] U.S. Cl. ..... 273/178 A; 273/176 J

[58] Field of Search ..... 273/178 R, 178 A, 178 B, 273/176 J, 177 B, 177 A, 179 C, 179 R, 180, 181 A, 127 B

[56] References Cited

U.S. PATENT DOCUMENTS

| | | | |
|---|---|---|---|
| 884,277 | 4/1908 | Hughes | 273/178 R |
| 1,229,766 | 6/1917 | Long | 273/178 A |
| 1,510,239 | 3/1923 | Mondsmith | 273/178 R |
| 1,656,740 | 1/1928 | Kurtz | 273/178 R |
| 2,836,422 | 5/1958 | Borah | 273/178 A |
| 3,081,090 | 3/1963 | Congleton | 273/176 F |
| 3,190,657 | 6/1965 | Johnson | 273/181 A |
| 3,512,262 | 5/1970 | Smyk et al. | 273/177 R |
| 4,171,134 | 10/1979 | Reck | 273/181 R |
| 4,359,225 | 11/1982 | Baldorossi et al. | 273/178 A |
| 4,647,047 | 3/1987 | Little | 273/178 A |
| 4,728,106 | 3/1988 | Shore | 273/177 R |

*Primary Examiner*—George J. Marlo
*Attorney, Agent, or Firm*—Peter D. Keefe

[57] ABSTRACT

A portable golf ball target having substantially the shape of a hollow frustum, thereby forming an inclined annulus with a central hole. On the inclined surface of the inclined annulus is a plurality of segments of radially directed golf ball guides which rise locally above the inclined surface and serve to guide a golf ball so that it will continue in straight line movement even when the golf ball encounters the inclined surface off center of the central hole. The preferred structure for the golf ball guides is in the form of short, flexible nibs, arranged in rows, which deform in conjunction with passage thereover by a golf ball. It is possible to also construct the golf ball guides in analogous fashion using radially directed, flexible ridges or the like. In an alternative embodiment, the inclined annulus is itself constructed of a flexible, resilient material, so as to assist keeping the golf ball headed in a straight line trajectory in the event of an off center encounter with the golf ball target.

10 Claims, 2 Drawing Sheets

FIG. 1
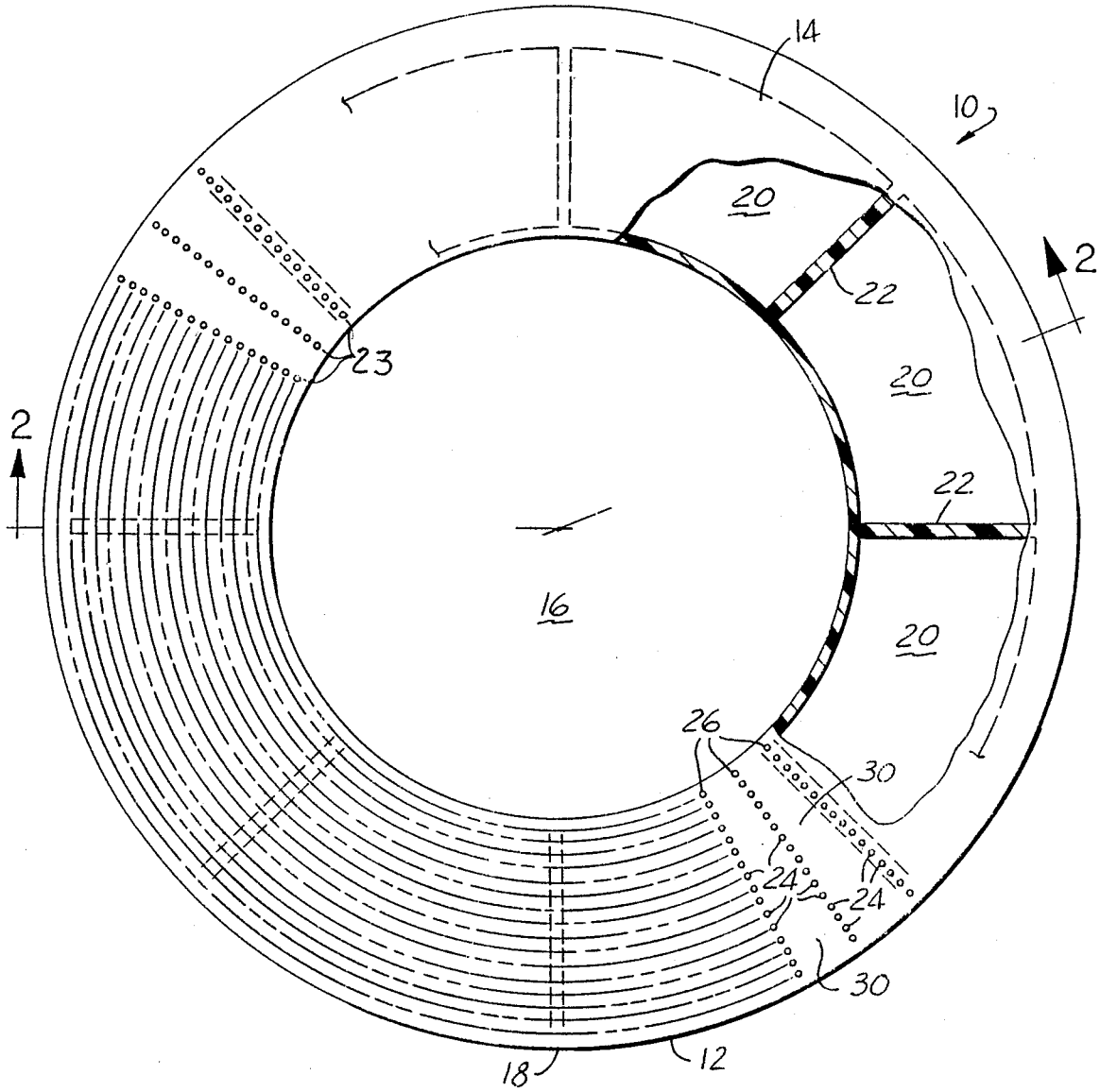
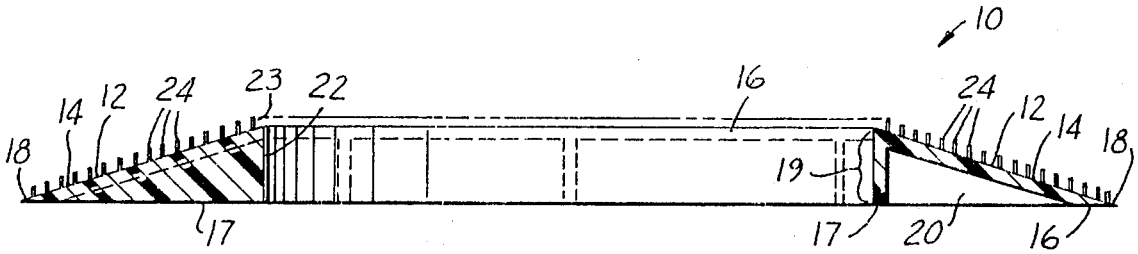
FIG. 2

PUTTING TARGET

BACKGROUND OF THE INVENTION

1. Field of the Invention

The present invention relates to golf ball targets, and more particularly to a portable golf ball target which more accurately simulates golf ball movement characteristics at an actual golf hole.

2. Description of the Prior Art

Many golfers prefer to improve their putting by practicing with golf ball targets which may be placed upon a floor. Generally, these golf ball targets have in common a specifically designated location toward which the golf ball is putted, the accuracy of the putt being determined by how proximately thereto the golf ball ends its roll.

Examples of golf ball targets are described in the following references. U.S. Pat. No. 884,277 to Hughes, dated Apr. 7, 1908, discloses an indoor golf game target in the form of an annulus with a straight edge for encountering the golf ball and a curved wall behind for striking the golf ball. U.S. Pat. No. 1,510,239 to Monosmith, dated Mar. 17, 1923, discloses a putting hazard in the form of a truncated cone with a dished top. U.S. Pat. No. 1,656,740 to Kurtz, dated Jan. 17, 1928, discloses a portable golf ball target having raised annular rings and a centrally positioned flag for use on a fairway. U.S. Pat. No. 3,081,090 to Congleton, dated Mar. 12, 1963, discloses an indoor, outdoor golf game including cup pad holes shaped in the form of a circular, inclined pad with a central hole. U.S. Pat. No. 3,190,657 to Johnson, dated June 22, 1965, discloses an inflatable golf ball target in the shape of a ring. U.S. Pat. No. 3,512,262 to Smyk et al, dated May 19, 1970, discloses a golf ball gauge and target in which the user may putt a golf ball toward it and, according to the inventor, the ball will make it up a rather very steep incline to a central opening. U.S. Pat. No. 4,171,134 to Reck, dated Oct. 16, 1979, discloses a golf game which includes an inclined circular cup having a central hole through which an anchor and flag pole may be placed. U.S. Pat. No. 4,647,047 to Little, dated Mar. 3, 1987, discloses a putting target which is structured to minimize the forces the golf ball must overcome at the target, thereby simulating conditions at an actual golf hole; the structure includes a truncated conical target having a flexible wall. Finally, U.S. Pat. No. 4,728,106 to Shore, dated Mar. 1, 1988, discloses a putting target which indicates to the user the precision of a putt by the nature of the deflection of the golf ball at the target; this deflection is determined by a centrally disposed ridge and a back wall.

The wide diversity of the above indicated prior art golf ball targets suggests an underlying need in the prior art, which has not yet been satisfied, to construct a portable golf ball target in which the ball reacts at the target in a manner very similar to the way it would react at an actual golf hole. Little, while trying to achieve this laudable result has not been entirely successful in that his flexible wall must be deformed at contact with the golf ball, thereby potentially altering its trajectory. What is needed, therefore, is a portable golf ball target which encounters the golf ball in a manner not unlike that of a natural golf hole by simulating all the conditions necessary to sink a golf ball in a natural hole.

SUMMARY OF THE INVENTION

The present invention is a portable golf ball target having substantially the shape of a hollow frustum, thereby having the form an inclined annulus with a central hole. On the inclined surface of the inclined annulus is a plurality of radially directed golf ball guides which rise locally above the inclined surface and serve to guide a golf ball so that it will continue in straight line movement even when the golf ball encounters the inclined surface off center of the central hole. The preferred structure for the golf ball guides is in the form of short, flexible nibs, arranged in rows, which deform in conjunction with passage thereover by a golf ball. It is possible to also construct the golf ball guides in analogous fashion using radially directed, flexible ridges or the like. In an alternative embodiment, the inclined annulus is itself constructed of a flexible, resilient material, so as to assist keeping the golf ball headed in a straight line trajectory in the event of an off center encounter with the golf ball target.

Accordingly, it is an object of the present invention to provide a golf ball target which is portable and may be used both indoors and outdoors, including an actual putting green.

It is a further object of the present invention to provide a golf ball target which is in the shape of a hollow frustum, that is light, durable and easily carried and used as desired.

It is an additional object of the present invention to provide a golf ball target which is in the shape of a hollow frustum, thereby being in the form of an inclined annulus with a central hole, the inclined annulus having an inclined surface covered with a plurality of golf ball guides which are locally raised above the inclined surface, deformation of which in response to pass-over by a golf ball, keeping the golf ball headed in a straight line movement across the inclined annulus.

It is another object of the present invention to provide a golf ball target which is in the shape of a hollow frustum, thereby being in the form of an inclined annulus with a central hole, the inclined annulus having an inclined surface covered with a plurality of golf ball guides which are in the form of rows of nibs, deformation of which in response to pass-over by a golf ball, keeping the golf ball headed in a straight line movement across the inclined annulus.

It is yet a further object of the present invention to provide a golf ball target which is in the shape of a hollow frustum, thereby being in the form of an inclined annulus with a central hole, so as to form an inclined annulus with a central hole, the inclined annulus being constructed of a resilient material, deformation of which in response to pass-over by a golf ball, keeping the golf ball headed in a straight line trajectory across the inclined annulus.

These, and additional objects, advantages, features and benefits of the present invention will become apparent from the following specification.

BRIEF DESCRIPTION OF THE DRAWINGS

FIG. 1 is a part sectional plan view of a golf ball target according to a first preferred embodiment of the present invention in which a plurality of radially directed rows of nibs are used as golf ball guides.

FIG. 2 is a part sectional side view of the golf ball target seen along lines 2—2 in FIG. 1.

DETAILED DESCRIPTION OF THE PREFERRED EMBODIMENTS

Figure 3:
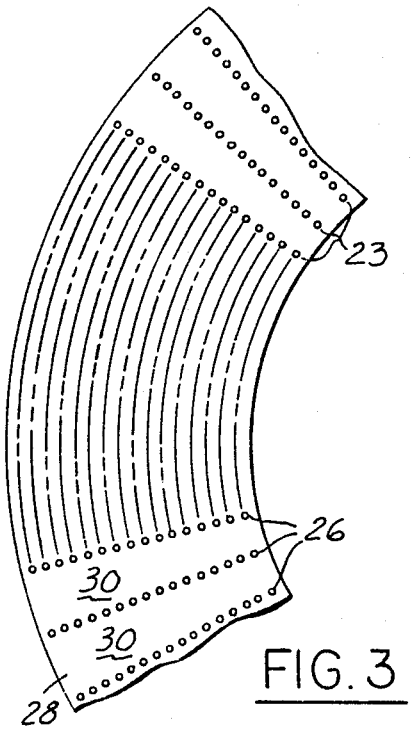
FIG. 3 is a detail plan view of the inclined annulus of the golf ball target according to the first preferred embodiment of the present invention, but now including a mat for providing nibs.

Referring now to the Drawings, FIG. 1 shows the golf ball target 10 according to a first preferred embodiment of the present invention. The golf ball target 10 is preferred to be constructed in a single piece of rigid or semi-rigid plastic, although it may be constructed of other materials, such as aluminum, composites or rubber. The shape of the golf ball target 10 is a hollow frustum, thereby forming an inclined annulus 12 having an inclined surface 14 and a central hole 16. The diameter of the inclined annulus is preferred to be on the order of seven and one-quarter inches and the diameter of the hole is preferred to be on the order of four and one-quarter inches, the diameter of an actual golf hole.

As can be best seen from FIG. 2, the inclined surface 14 meets the flat bottom 17 of the golf ball target at the perimeter 18 and inclines therefrom to a maximum height 19 adjacent the hole 16. The maximum height of the inclined annulus 12 is preferred to be on the order of one-half inch, thereby giving the inclined surface a slope on the order of 3 to 1. It is further preferred, in order to reduce both cost and weight of the golf ball target 10, to construct the inclined annulus so as to include hollowed out interior spaces 20, separated by reinforcing members 22.

Figure 8:
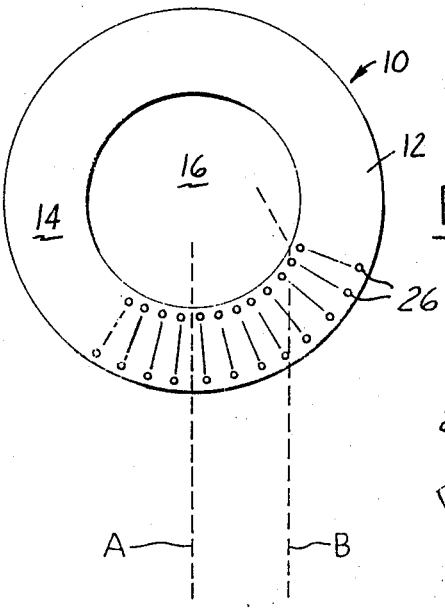
FIG. 8 shows projected paths for golf balls encountering the golf ball target according to the present invention.

When a golf ball encounters the inclined annulus 12 in a direction that is on center with the central hole, as indicated by path A in FIG. 8, it will continue in straight line motion right up the inclined surface 14 into the hole 16. The slope of the inclined surface is such that if the golf ball was putted with too much force, the golf ball will then bounce out of the hole, meaning a real-life putt with this sort of force would have sent the golf ball over the hole, or so far past the hole that the return putt could easily be missed. Further, the slope of the inclined surface is also such that if the golf ball was not putted with sufficient force, it will not make it up the inclined surface, meaning it would not have dropped in a real hole on the golf course, or would not have traveled the optimum distance with respect to the hole which is approximately twelve inches for missed putts.

The situation could be a bit different if the golf ball encountered the inclined annulus off center, since the incline of the inclined surface 14 would tend to deflect the golf ball in a manner unknown in real-life encounters with golf holes out on the green. Accordingly, to preserve a true-to-life simulation of a golf ball encounter with a hole, golf ball guides 23 are provided on the inclined surface 14. It is preferred that the golf ball guides 23 be arranged in a plurality of segments on the inclined surface in an orientation which is radial with respect to the center of the central hole 16. The preferred structure for the golf ball guides 23 is a plurality of upstanding nibs 24 arranged in a number of radially oriented rows 26 on the inclined surface 14 of the inclined annulus 12. It is preferred that the nibs 24 be integrally connected with the inclined annulus 12, rubber or plastic being preferred construction materials; the nibs are made of a sufficiency small cross-section that even though the inclined annulus may be semi-rigid, the nibs have the mechanical properties of flexibility and resiliency. A preferred cross-section of the nibs is one-thirtysecondth inch and a preferred length thereof is one-eighth inch. The rows 26 are preferred to be spaced one-quarter inch apart at their closest distance of separation, which is located adjacent the central hole 16. The nibs themselves are preferred to be spaced along each row one-sixteenth inch apart. In FIGS. 1 and 2 the nibs are shown individually integrally interconnected with the inclined annulus 12, the integral interconnection being accomplished by producing the inclined annulus and the nibs simultaneously in a single piece mold. Alternatively, and less preferably, the nibs could be connected with the inclined annulus nonintegrally by adhesive, sonic welding or other technique known to the skilled artisan.

Figure 4:
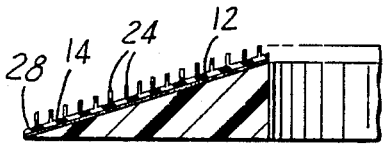
FIG. 4 is a detail part sectional side view of the inclined annulus and mat with integral nibs of the golf ball target of FIG. 3.

FIGS. 3 and 4 show an alternative structure for providing the nibs onto the inclined annulus. The nibs 24 are formed integrally with a single piece mat 28, the mat then being attached to the inclined annulus by an adhesive, sonic welding or other common attachment means. The mat now serves as the inclined surface for purposes of golf ball encounter, and is designated as 14'.

Figure 9:
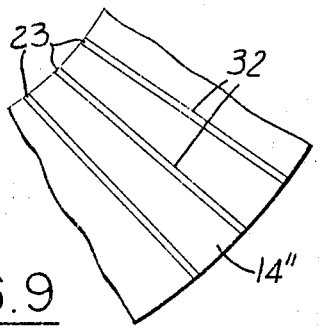
FIG. 9 is a partial plan view of an alternative embodiment of the golf ball target according to the present invention in which a plurality radially directed ridges are used as golf ball guides.

The primary focus of the present invention is to provide golf ball guides 23 so that the golf ball, when it encounters the inclined surface, will continue to follow a straight course up the inclined surface irrespective of the angle with which it encounters the inclined annulus. Accordingly, FIG. 9 shows an alternative structure of the golf ball guides 23 in which a mat having a plurality of radially oriented ridges 32 is provided instead of a mat having a plurality of rows of nibs. The mechanical properties of the ridges are substantially the same as those recounted above relative to the nibs, and the ridges can be integral with the inclined annulus, as described above relative to the nibs.

Figure 7:
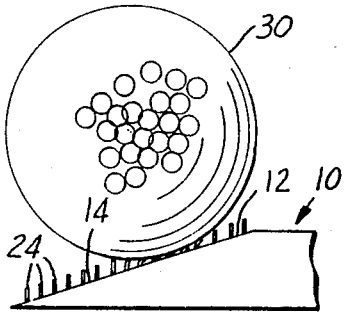
FIG. 7 is a side view showing the golf ball target, as shown in FIG. 1, in operation, in which the inclined annulus and its associated nibs are shown interacting with a golf ball.

Now, when a golf ball is putted toward the golf ball target, and it encounters the inclined annulus at an angle of direction which is off center of the central hole, rather than being adversely deflected by its incline, the golf ball guides (nibs, ridges or the like) are deformed immediately under the golf ball while those in immediate adjacency with the golf ball also contribute to press against the golf ball, as shown in FIG. 7, where the golf ball is indicated by numeral 30. The net affect of the golf ball guides pressing against the golf ball causes the golf ball to tend to follow the radial oriented space 30 between the golf ball guides (rows of nibs, ridges or the like) thereby counteracting the tendency of the golf ball to deflect because of the incline of the inclined surface 14. The net result is indicated by path B in FIG. 8, which is a truer simulation of golf ball behavior at an actual golf hole than has been achieved to date by any other device: if the putt has the right amount of force as would be used out on the green, then the golf ball will end up in the central hole 16, the incline of the inclined surface 14 notwithstanding.

Figure 5:
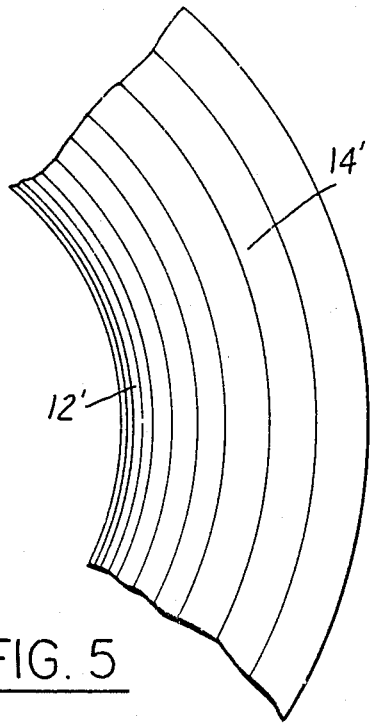
FIG. 5 is a detail plan view of a second preferred embodiment of the golf ball target according to the present invention, in which the inclined annulus is made of a flexible material.
Figure 6:
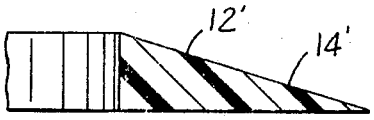
FIG. 6 is a detail part sectional side view of the inclined annulus of the golf ball target as shown in FIG. 5.

FIGS. 5 and 6 show an alternative embodiment of the golf ball target, where the inclined annulus 12' is constructed of a flexible, resilient material, such as soft plastic or rubber. It is preferred that the inclined annulus to be solid, without any interior hollow areas or reinforcing members. This construction may obviate need of the nibs, since the inclined surface 14'' is itself deformable in response to the weight of the golf ball. Accordingly, if the golf ball encounters the inclined annulus 12' in a direction which is angled off center of the central hole 16, the inclined annulus is deformed by the weight of the golf ball so as to counteract the tendency of the golf ball to deflect caused by the incline of the inclined surface 14''. Therefore, the golf ball will follow a truer course, closely simulating an actual encounter with a golf ball hole out on the green.

Lastly, certain of the objects of the present invention may be accomplished by constructing the inclined annulus out of a light, durable material, such as plastic, aluminum or a composite, without the inclusion of nibs. Such a structure may also include the hollowed out interior spaces 20 and the reinforcing members 22, in order to minimize cost and weight. Such a structure would have the exterior appearance shown in FIG. 5 and internal structure shown in FIG. 2.

To those skilled in the art to which this invention appertains, the above described preferred embodiments may be subject to change or modification. In this regard, it may be possible to those having ordinary skill in the art to construct the golf ball guides differently from the preferred embodiments described above, as for instance by utilizing grooves instead of ridges, laid out as shown in FIG. 9. Such change or modification can be carried out without departing from the scope of the invention, which is intended to be limited only by the scope of the appended claims.

What is claimed is:

1. A target for a golf ball, comprising:

an inclined annulus of frustum shape, said inclined annulus having an inclined surface and a central hole; and golf ball guidance means located on said inclined surface of said inclined annulus, said golf ball guidance means comprising a plurality of upstanding flexible resilient segments, each segment being oriented radially with respect to said central hole;

whereby, when the golf ball encounters the target after being putted theretoward, the golf ball will tend to continue in a straight path due to interaction with said golf ball guidance means, even in situations where the golf ball encounters said inclined surface in a direction oriented off center of said central hole.

2. The target for a golf ball of claim 1, wherein said golf ball guidance means comprises a plurality of nibs projecting upwardly from said inclined surface of said inclined annulus, each nib of said plurality of nibs being flexible and resilient, each segment of said plurality of segments comprising a row of said nibs.

3. The target for a golf ball of claim 2, wherein said nibs and said inclined annulus are integrally formed.

4. The target for a golf ball of claim 3, wherein said inclined surface has a slope of substantially 3 to 1, and said central hole has a diameter substantially equal to that of holes used for a conventional golf course; further wherein each nib has a length of substantially one-eighth inch, each nib has a diameter of substantially one-thirtysecondth inch, and each nib is separated from each other nib along each row by a distance of substantially one-sixteenth inch; further wherein each row is separated from its adjacent rows by a distance of substantially one quarter inch at their respectively closest distance of separation; and further wherein said inclined annulus has hollowed out interior spaces adjacent said inclined surface; said inclined annulus further comprising a plurality of reinforcing members, said hollowed out interior spaces being mutually separated by said reinforcing members.

5. The target for a golf ball of claim 2, further comprising a mat, said plurality of nibs being integrally formed with said mat, said mat being structured to cover said inclined surface of said inclined annulus, said mat being attached to said inclined surface of said inclined annulus.

6. The target for a golf ball of claim 5, wherein said inclined surface has a slope of substantially 3 to 1, and said central hole has a diameter equal substantially to that of holes used in a conventional golf course; further wherein each nib has a length of substantially one-eighth inch, each nib has a diameter of substantially one-thirtysecondth inch, and each nib is separated from each other nib along each row by a distance of substantially one-sixteenth inch; further wherein each row is separated from its adjacent rows by a distance of substantially one quarter inch at their respectively closest distance of separation; and further wherein said inclined annulus has hollowed out interior spaces adjacent said inclined surface; said inclined annulus further comprising a plurality of reinforcing members, said hollowed out interior spaces being mutually separated by said reinforcing members.

7. The target for a golf ball of claim 1, wherein each segment of said plurality of segments comprises a ridge projecting upwardly from said inclined surface of said inclined annulus, each ridge being flexible and resilient.

8. The target for a golf ball of claim 7, wherein said inclined surface has a slope of substantially 3 to 1, and said central hole has a diameter equal substantially to that of holes used for a conventional golf course; further wherein each ridge has a height of substantially one-eighth inch, and each ridge has a thickness of substantially one-thirtysecondth inch; further wherein each ridge is separated from its adjacent ridge by a distance of substantially one quarter inch at their respectively closest distance of separation; and further wherein said inclined annulus has hollowed out interior spaces adjacent said inclined surface; said inclined annulus further comprising a plurality of reinforcing members, said hollowed out interior spaces being mutually separated by said reinforcing members.

9. The target for a golf ball of claim 1, wherein said inclined annulus has hollowed out interior spaces adjacent said inclined surface; said inclined annulus further comprising a plurality of reinforcing members, said hollowed out interior spaces being mutually separated by said reinforcing members.

10. The target for a golf ball of claim 9, wherein said inclined surface has a slope of substantially 3 to 1.

* * * * *